US005581944A

United States Patent [19]

Kornbrekke et al.

[11] Patent Number: 5,581,944

[45] Date of Patent: Dec. 10, 1996

[54] ELECTRICAL LINK AND SENSOR SYSTEM FOR AUTOMATIC SLIDING DOORS

[75] Inventors: Henning N. Kornbrekke, Burlington; Anthony R. Ranaudo, Bethlehem; Alexander M. Mitchell, Hamden; Gary V. Roberts, Rocky Hill, all of Conn.

[73] Assignee: The Stanley Works, New Britain, Conn.

[21] Appl. No.: 88,824

[22] Filed: Jul. 8, 1993

[51] Int. Cl.[6] ..... E05F 15/02

[52] U.S. Cl. ..... 49/28; 49/27; 49/360

[58] Field of Search ..... 49/26, 27, 28, 49/25, 118, 123, 116, 334, 360, 349, 358; 200/61.43

[56] References Cited

U.S. PATENT DOCUMENTS

| | | | |
|---|---|---|---|
| 1,793,716 | 2/1931 | Parvin | 49/27 |
| 2,135,131 | 11/1938 | Bassett | 49/27 X |
| 3,040,839 | 6/1962 | Panter | 49/27 |
| 3,300,897 | 1/1967 | Wikkerink . | |
| 4,029,176 | 6/1977 | Mills | 49/25 X |
| 4,050,189 | 9/1977 | Peterson | 49/26 |
| 4,560,912 | 12/1985 | Jönsson | 49/25 X |
| 4,565,029 | 1/1986 | Kornbrekke et al. | 49/28 X |
| 4,621,452 | 11/1986 | Deeg | 49/28 |
| 4,698,967 | 10/1987 | Longora | 49/27 X |
| 4,855,653 | 8/1989 | Lemarande | 49/28 X |
| 5,142,152 | 8/1992 | Boiucaner . | |
| 5,189,836 | 3/1993 | Alder et al. | 49/27 X |

FOREIGN PATENT DOCUMENTS

| | | |
|---|---|---|
| 0173829A3 | 7/1985 | European Pat. Off. . |
| 0499884A1 | 2/1992 | European Pat. Off. . |

OTHER PUBLICATIONS

Translation from German to English of European Patent No. 0 173 829 A3.

*Primary Examiner*—Kenneth J. Dorner
*Assistant Examiner*—Jerry Redman
*Attorney, Agent, or Firm*—Chilton, Alix & Van Kirk

[57] ABSTRACT

A sliding door system employs an electric power link. The electric link includes a ribbon conductor which is enclosed in a protective chain-like guard to provide electrical communication between the sliding door and the door header. Electrical modules such as electromagnetic locks, switches and sensors are mounted directly on the sliding door. Safety sensors are mounted at the leading and trailing edges of the sliding door panels to sense whether an obstacle or traffic has cleared.

30 Claims, 11 Drawing Sheets

ELECTRICAL LINK AND SENSOR SYSTEM FOR AUTOMATIC SLIDING DOORS

BACKGROUND OF THE INVENTION

The present invention relates generally to automatic sliding doors. More particularly, the present invention relates to sensor and safety systems which control the operation of automatic sliding doors.

Sliding door systems of a type which are automatically operable for initiating an opening sequence upon sensing the motion or the presence of traffic at the doorway or receiving a command from a push plate, card reader, mat or other operation initiating device are now commonplace. A number of automatic door systems employ infra-red sensors to initiate the door opening sequence. The sensors sense traffic approaching the doorway by detecting changes in received active or passive infra-red radiation. Infra-red sensors also function as safety devices to ensure that the sliding doors do not inadvertently close.

Some conventional sliding door applications employ three separate sensor units—none of which are mounted to a sliding door. Two approach sensor units are positioned for coverage at each side of the sliding door. A threshold or safety sensor covers the threshold area in which the moving door panels travel. The approach sensors may conventionally be microwave field distortion devices or active infra-red motion sensing devices. The threshold sensors are conventionally presence sensing devices such as continuous infra-red beams.

Kornbrekke et al U.S. Pat. No. 4,823,010, assigned to the assignee of the present invention, discloses a novel threshold safety sensor for a sliding door system. The system employs infra-red transmitters and a photodiode for detecting traffic at or near the threshold of the sliding door system. The threshold sensor includes an elongated enclosure or rectangular housing which mounts at the underside of the door header or above the threshold. The threshold sensor is a safety sensor specifically adapted to detect the presence of an object at or near the threshold when the doors are opening or are in an opened position. A motion sensor mounted at the header or above the entranceway generates a signal to initiate the movement of the door to the opening position.

Boiucaner U.S. Pat. No. 5,142,152, assigned to the assignee of the present invention, discloses a sliding door sensor which mounts at the underside of the header above the threshold. Two arrays of infra-red transmitters are pulsed to provide an approach detection zone and a threshold detection zone. Both presence and motion detection are provided. The sensor also is capable of detecting dark objects.

Most sensor systems employed in conjunction with sliding doors are mounted to the headers or adjacent fixed frame supports for the sliding doors. Because of the sliding motion of the doors, providing electrical power to the sliding door panel itself, or a sensor signal communication from the sliding door panel has been problematical. Accordingly, the sliding doors for the vast majority of automatic sliding door systems do not have any electrical power, and few sliding door systems employ sensors mounted on the sliding doors. It should also be noted that because of the sliding movement of the doors, the sensor systems which are employed in controlling the operation of sliding door systems must take into account the movement of the sliding door itself. Accordingly, sophisticated signal processing may be required to properly account for the door movement.

SUMMARY OF THE INVENTION

Briefly stated, the invention in a preferred form is directed to an electrical link between the door header and the sliding door panel and to a sensor system which employs the link. The electrical link provides power and signal communication directly with and from the sliding door panel. The header above the entranceway for the sliding door system includes a first stationary electrical junction. At least one electrical module is mounted to the sliding door. The electrical module may take the form of a sensor, a switch, a light, a transparent panel circuit or an electrical lock. The module electrically communicates with a second junction on the sliding door. An electrical link which comprises a flexible ribbon conductor connects the first and second junctions. A protective enclosure encloses the connector. The integrity of the electrical connection is maintained as the door slides along the tracks—even after large numbers of duty cycles.

In a preferred form, the electrical link includes a ribbon conductor which is enclosed in a multi-pivotable chain-like guard. The conductor and enclosure are located in the housing and define a variable U-shaped path as the door moves across the entranceway. A portion of the guard rests on a shelf which is mounted in fixed relationship at the top of the door.

The protective enclosure for the ribbon conductor may also comprise a pair of cooperative channel members. One member is mounted in fixed relationship with the header. The other member is mounted in fixed relationship to the sliding door.

In one preferred embodiment, infra-red through beams are positioned at the leading edge of the sliding door stile to provide a safety sensor for holding the sliding doors in an opened position while traffic is sensed at the threshold. A safety sensor unit at the leading edge of the door may also incorporate a diffuse reflective sensor. One or more edge sensors are also mounted at the trailing edge of the door stile to prevent the door from opening if an object or individual is positioned adjacent the trailing edge of the door when the door is closed, or to cause the door to open slowly when the door is in its opening cycle.

An object of the invention is to provide a new and improved sliding door system which incorporates an efficient electrical link between the door header and the sliding door.

Another object of the invention is to provide a new and improved sliding door electrical link system which operates in a reliable and efficient manner to provide electrical communication between the sliding door and the stationary doorframe.

A further object of the invention is to provide a new and improved sliding door system wherein sensors and other electrically operated modules may be mounted on the sliding door.

A yet further object of the invention is to provide a new and improved sliding door system wherein safety sensors may be mounted to the sliding door to provide enhanced detection capabilities.

Other objects and advantages of the invention will become apparent from the drawings and the specification.

DETAILED DESCRIPTION OF THE PREFERRED EMBODIMENT

Figure 1:
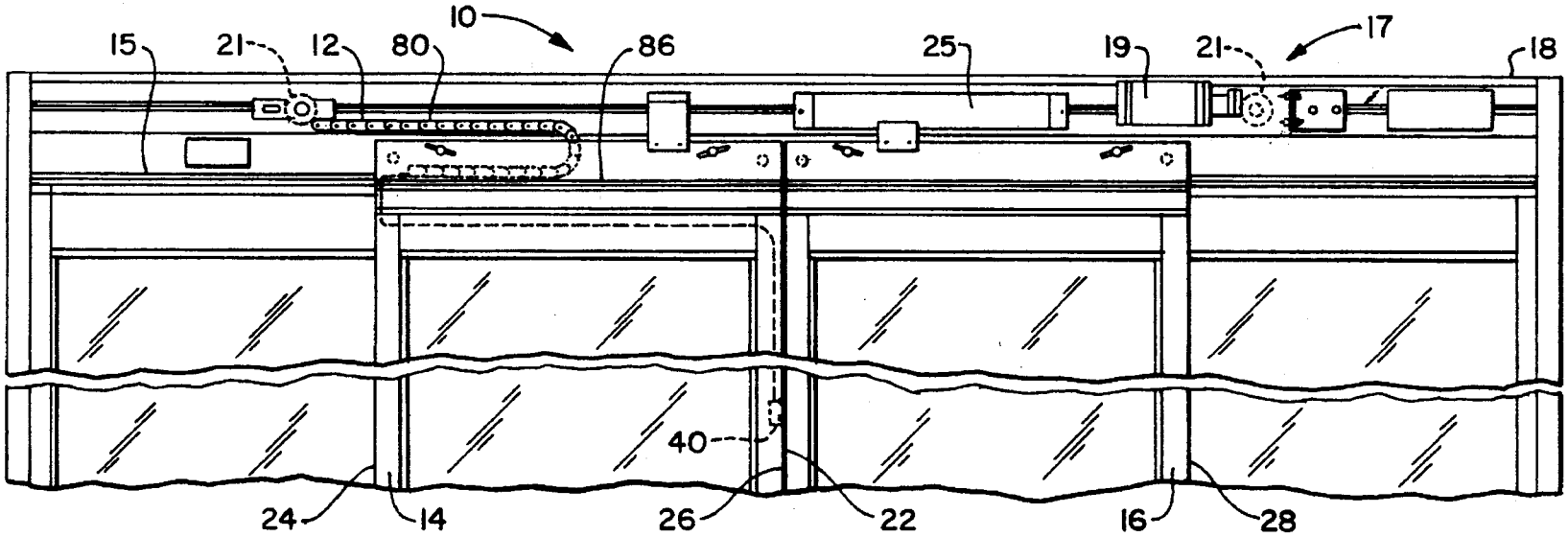
FIG. 1 is a fragmentary front elevational view, partly broken away and partly in schematic, of a sliding door system incorporating an electrical link system in accordance with the present invention.
Figure 5:
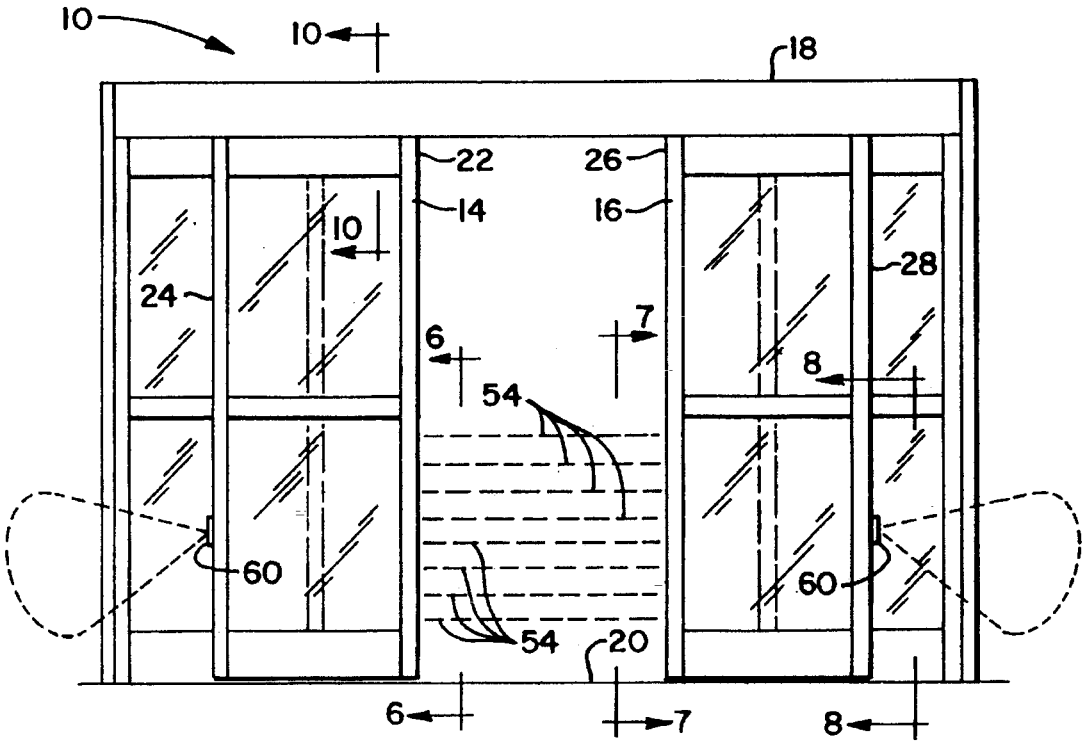
FIG. 5 is a full front elevational view, partly in schematic, of a second embodiment of the sliding door system of FIG. 1, the doors being illustrated in an opened position.

With reference to the drawings wherein like numerals represent like parts throughout the Figures, a sliding door system designated generally by the numeral 10 in FIG. 1 incorporates an electrical link system 12. The automatic sliding door system includes a single door or a pair of moveable doors or panels 14 and 16 which synchronously slide along a track 15 under the control of an automatic door operator 17. The automatic door operator 17 is mounted in the door header 18 above the threshold 20 (FIG. 5). The front panel of the header has been removed in the FIG. 1 drawing.

Figure 12:
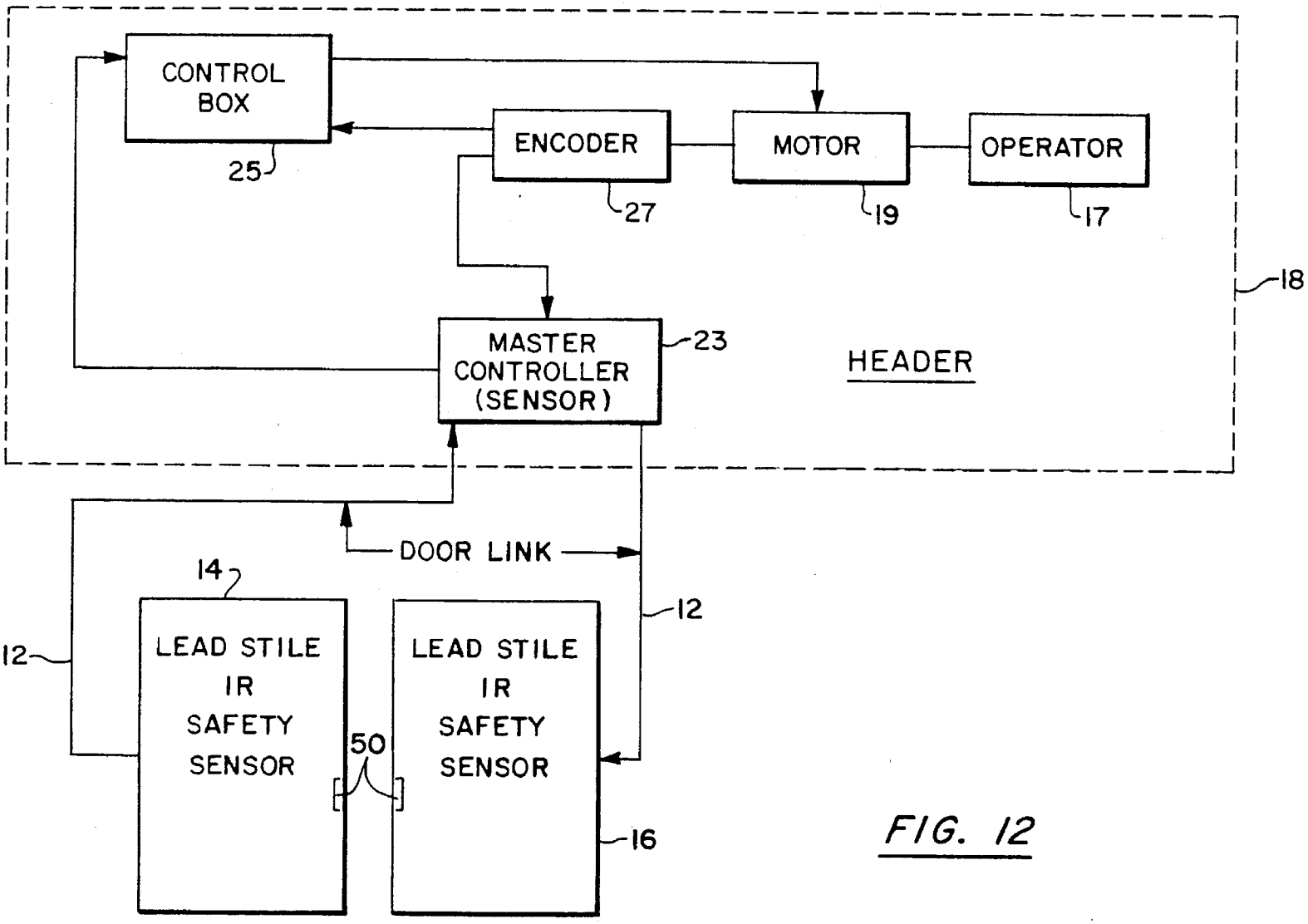
FIG. 12 is a block diagram generally illustrating the signal relationships for the sliding door system employing the sliding door illustrated in FIG. 11.

The automatic door operator 17 may be any of numerous forms which automatically control the operation of the sliding doors, such as the operator system disclosed in U.S. Pat. No. 4,563,625, assigned to the assignee of the present invention. The operator 17 may further include a motor 19 which drives a belt (not illustrated) suspended from a pair of pulleys 21 for moving the doors. With reference to FIG. 12, a master controller 23 generates and transmits commands to a control box 25 for the motor 19. An encoder 27 is employed for determining the positions of the doors.

Figure 19:
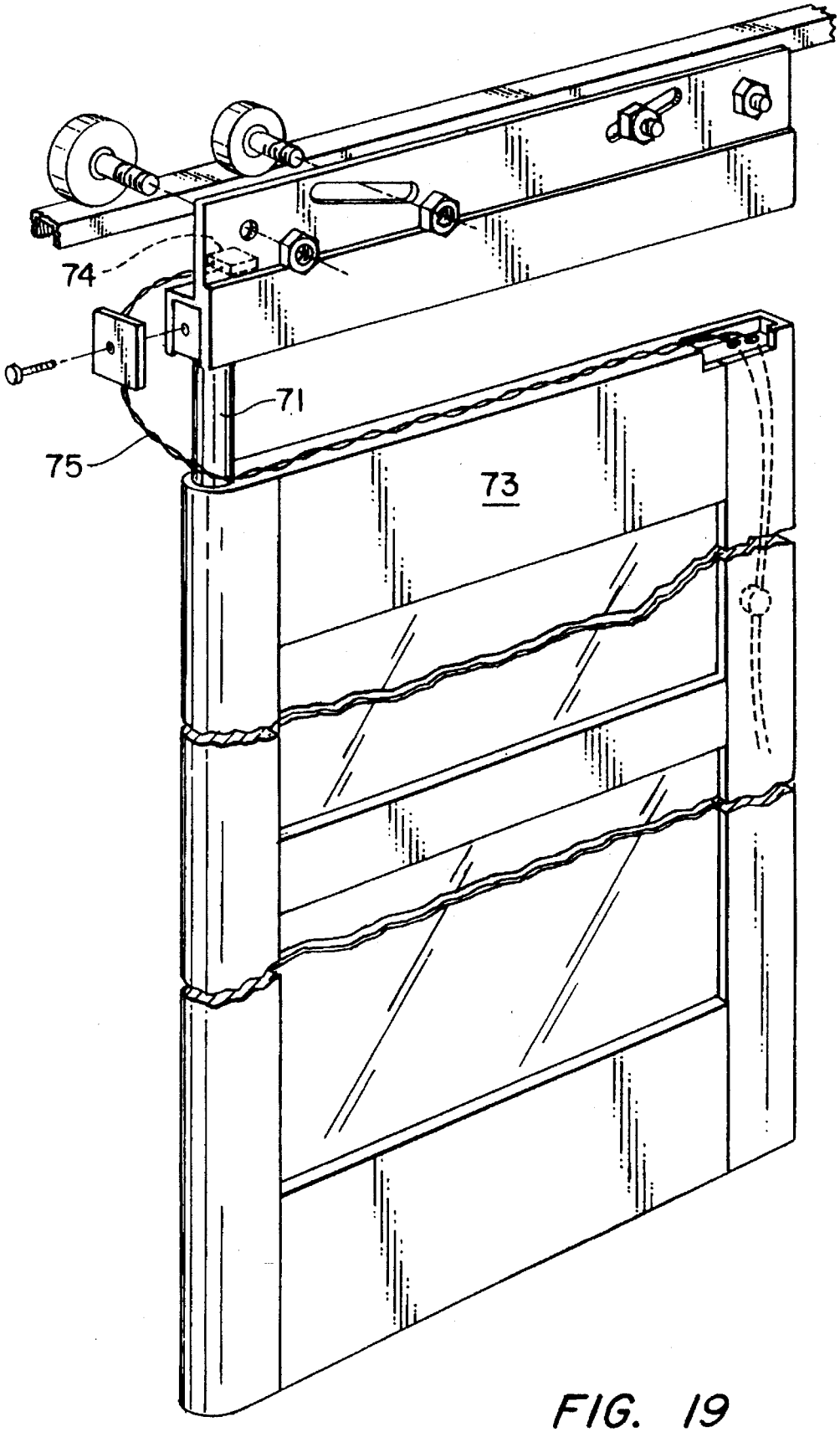
FIG. 19 is an exploded perspective view of a sliding door of FIG. 1, partly broken away and partly in schematic, illustrating a breakout door feature for the electrical link system.

With reference to FIGS. 1 and 5, door panel 14 includes a leading stile edge 22 and an opposite trailing stile edge 24. Likewise, panel 16 includes a leading stile edge 26 and an opposite trailing stile edge 28. In the closed position, stile edges 22 and 26 abut or are closely adjacently positioned. The panels 14 and 16 may be manufactured from aluminum frame members or other suitable materials which are hollow to permit the introduction and housing of electrical leads. The doors may also have a breakaway pivoting feature for use in an emergency, such as illustrated in FIG. 19. As will be described below one or both of the panels 14 and 16 are electrified. Alternately, for installations which employ a single door panel (not illustrated), one door panel and an adjacent door jamb are electrified. Although only panel 14 is illustrated as electrified in FIG. 1, the description relative to panel 14 is equally applicable to panel 16.

Figure 11:
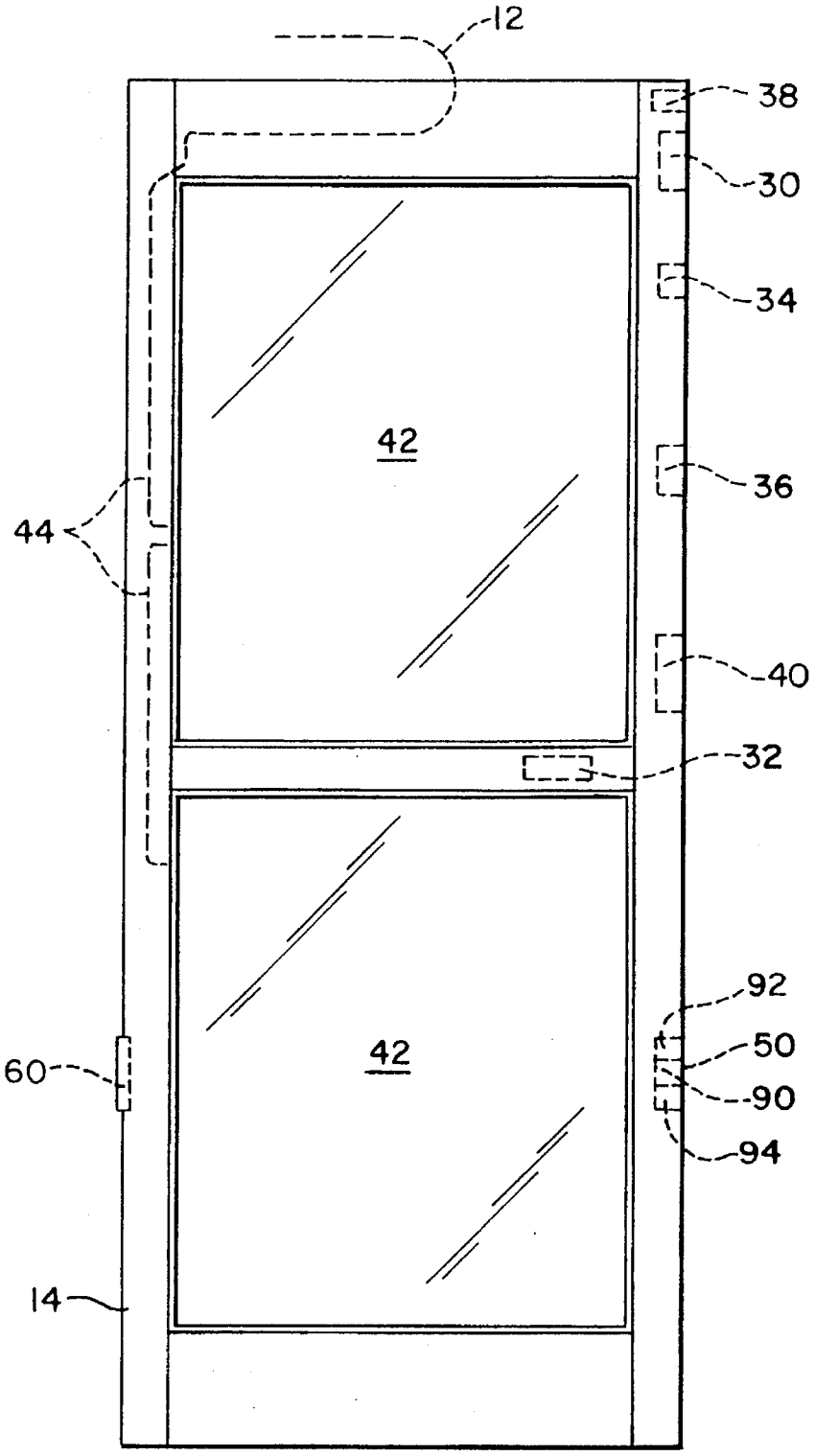
FIG. 11 is an enlarged elevational view, partly in schematic, of a sliding door and a portion of the electrical system for a third embodiment of a sliding door system in accordance with the invention.

With additional reference to FIG. 11, sliding door panel 14 (and/or panel 16) may mount one or more of a wide variety of electrical modules, such as for example, an electric solenoid actuatable lock 30, a push plate 32, a warning light 34, an alarm 36 or a micro or reed switch 38 for detecting break out. An approach sensor 40 may be also mounted to the sliding door for sensing approaching traffic at the entranceway. The door may have glass panels 42 which are coated with a material which is opaque but becomes transparent when an electric current is applied to the material via an electric circuit 44. The specific positions of the modules illustrated in FIG. 11 may vary. The modules electrically communicate via the electrical link 12 with a remote console and/or the controller 23 and ultimately the sliding door operator 17.

Electrification of the door enhances the safety detection coverage by allowing for the safety sensors to be mounted directly on the sliding door panels at optimum sensing locations. A safety sensor 50 is preferably mounted at the leading stile edges 22 and 26. The safety sensor 50 incorporates a diffuse reflective sensing unit and a holding beam for sensing traffic at the threshold 20 and the threshold vicinity, as will be described below.

Figure 8:
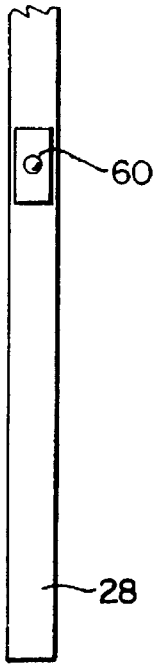
FIG. 8 is an enlarged fragmentary end elevational view of a door panel of the sliding door system of FIG. 5 taken along the line 8—8 thereof.

Infra-red sensors 60 (FIGS. 5, 8 and 11) are also preferably positioned at the trailing edges of panels 14 and 16 at approximately 28 inches off the floor. The infra-red sensors 60 sense obstructions at the trailing edges of the sliding doors. If the doors are closed and an obstruction is sensed by a sensor 60, the doors will not open. If the doors are in an opening sequence and an obstruction is sensed by a sensor 60 in the vicinity of the trailing edge of the sliding door, the doors will open at a slow speed. Thus, an efficient bi-directional safety sensor is provided by sensors 50 and 60.

Figure 6:
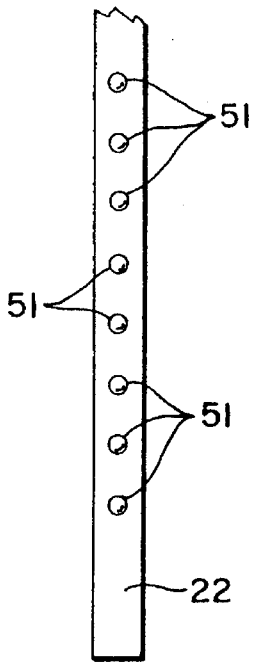
FIG. 6 is an enlarged fragmentary end elevational view of a door panel of the sliding door system of FIG. 5 taken along the line 6—6 thereof.
Figure 7:
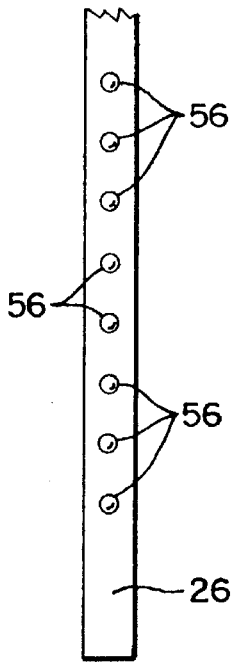
FIG. 7 is an enlarged fragmentary end elevational view of a door panel of the sliding door system of FIG. 5 taken along the line 7—7 thereof.
Figure 9:
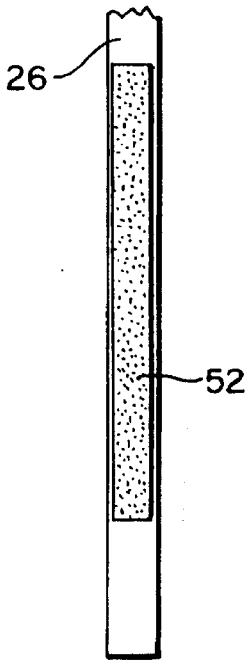
FIG. 9 s an enlarged fragmentary end elevational view of a modified embodiment of the sliding door system of FIG. 5 taken along the line 7—7 thereof.

With reference to FIGS. 5, 6 and 9, in one alternative embodiment which does not employ safety sensors 50, eight infra-red retroflective holding beam sensors 51, which are equidistantly spaced at 4 inch intervals on center, are located at the leading edge 22 of door 14. A reflective strip 52 (FIG. 9) is mounted at the leading edge 26 of door 16. The sensors generate multiple holding beams 54 which traverse between the edges 22 and 26 at vertically spaced heights above the threshold. The beams are reflected back to the sensors by the reflective strip 52 if there are no obstacles or there is no traffic between edges 22 and 26. The infra-red holding beams function as efficient safety sensors to sense the presence of traffic in the doorway and to prevent the sliding doors 14 and 16 from closing until the traffic has cleared the entranceway. Alternately, receivers 56 (FIG. 7) may be mounted at the leading edge 26 for detecting infra-red radiation from sensors 51 which are thus infra-red transmitters. In other embodiments (not illustrated), transmitters and receivers may be alternately positioned at each of the leading edges 22 and 26.

With reference to FIGS. 1 thru 4 and 19, the electrical link system 12 comprises a ribbon cable 70 which connects at one end to an electrical junction 72 at the header. The opposite end of the ribbon cable connects to a junction 74 on a sliding door. In one preferred embodiment, the ribbon cable is a 4 foot cable such as a flexible flat FFC cable marketed by Amp, Inc. of Harrisburg, Pa. The cable 70 has a single row receptacle housing 76 at each end of the cable to facilitate connection at the junctions. An electrical link system 12 may be employed for each sliding door.

One or more electric wires 75 (which need not be ribbon cables and only one of which is illustrated) connect at junction 74 and extend transversly through the hollow upper door rail and generally vertically hollow through the lead and trailing stiles of the door to connect with the modules, including the sensors as best illustrated in FIG. 12. With reference to FIG. 19, for doors which can be pivotally forced outwardly during an emergency, the wire 75 is positioned so that the wire essentially loops around the emergency break away pivot 71 for the door. Should it be necessary to break the door away by forcefully pivoting the door section 73 about pivot 71, the disposition of the electrical junction 74 and the wire 75 relative to the door pivot 71 allows for continued electrification of the door even during the emergency break out condition of the door.

Figure 2:
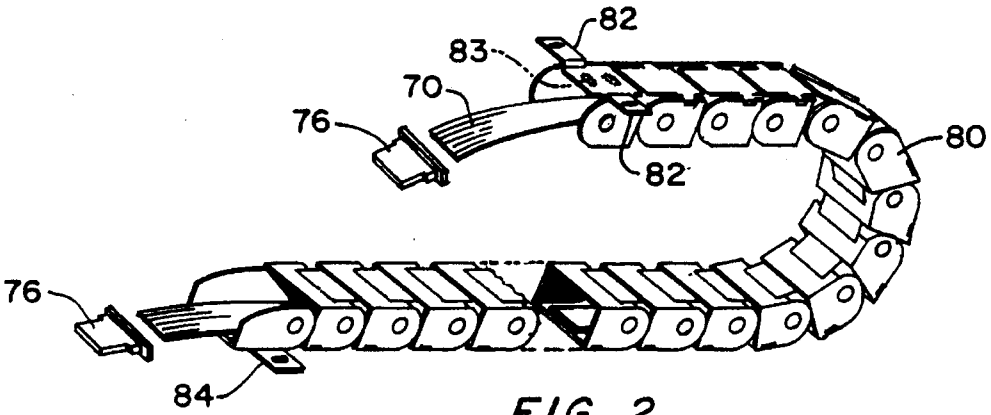
FIG. 2 is an enlarged fragmentary perspective view, partly in phantom and partly exploded, of the electrical link system of FIG. 1.
Figure 10:
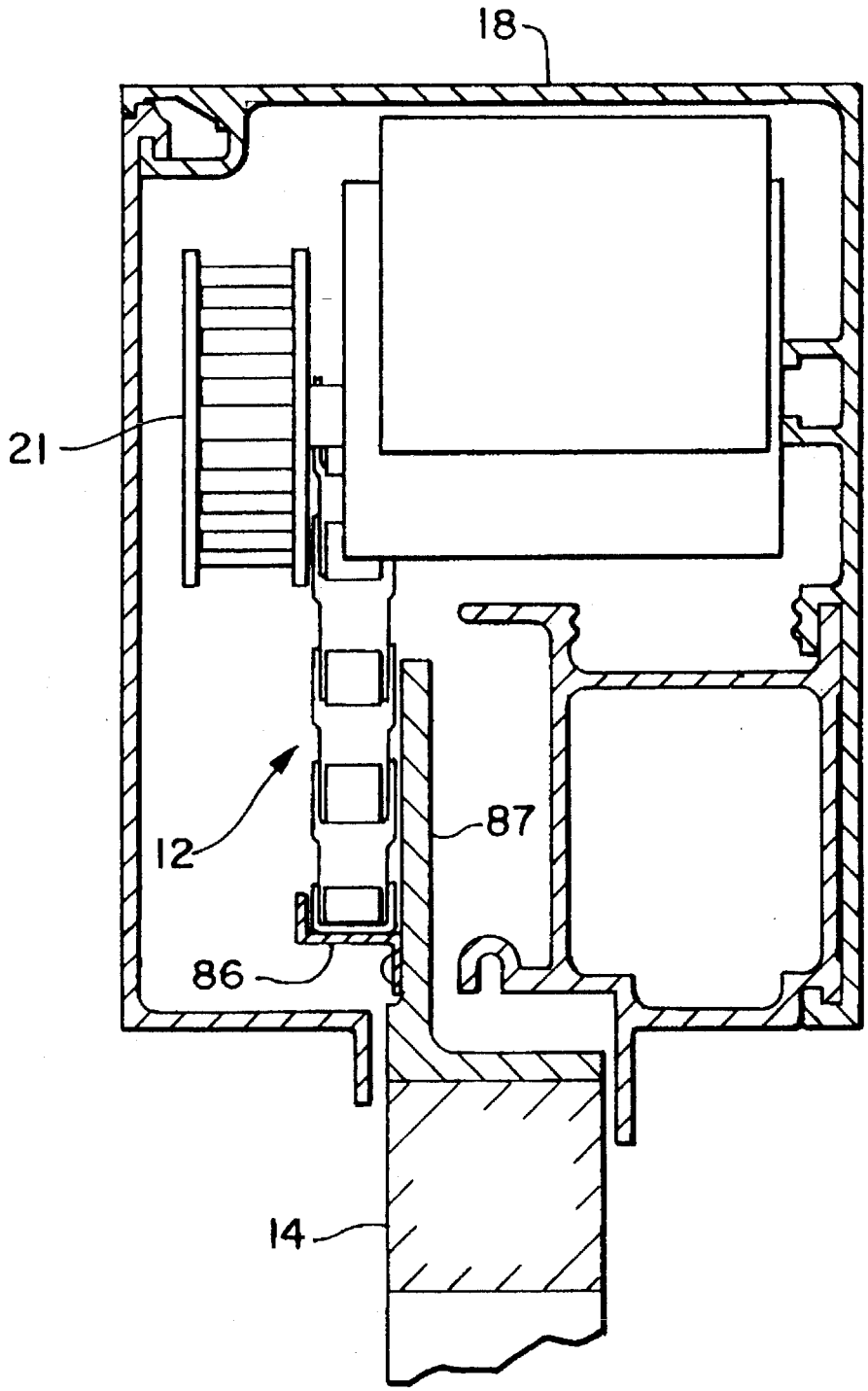
FIG. 10 is an enlarged fragmentary sectional view of the sliding door system of FIG. 5 taken along the line 10—10 thereof.

With reference to FIG. 2, the cable 70 is enclosed in a chain guard 80 such as the E-Chain™ Cable Carrier System of Igus Inc., East Providence, R.I. The top of the chain guard 80 at one end may have a pair of ears 82 with openings which receive fasteners for fixedly mounting the chain guard 80 to the header. The bottom opposing end of the chain guard also has ears 84 to fixedly mount the guard end to the top of the sliding door. Alternately, the ends of the chains guard may be anchored by fasteners which extend through pre-formed openings 83 in the end links or segments. The bottom portion of the guard rests on a shelf 86 fixedly mounted to a door hanger 87 (FIG. 10) of the door panel or a shelf (not illustrated) of the header. The various electrical leads for each of the electrical modules and/or sensors connect with the junction 74 at the sliding door which mates with the housing 76 of the electrical connector.

Figure 3:
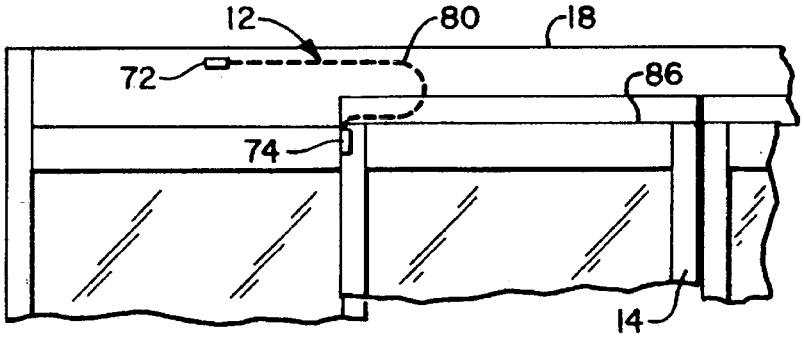
FIG. 3 is a fragmentary frontal view, partly in schematic, of the electrical link system and the sliding door system of FIG. 1, illustrated in a closed door position.
Figure 4:
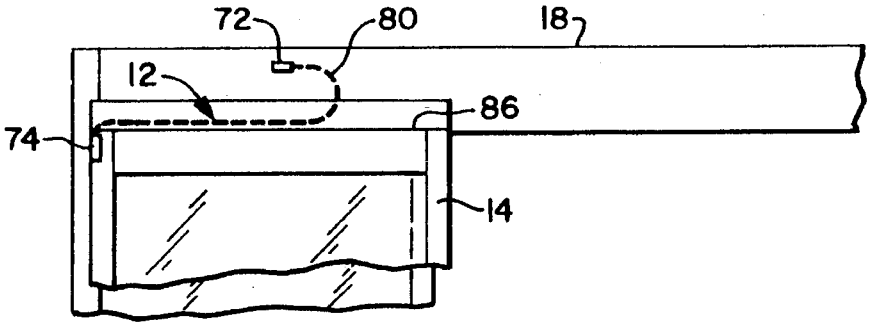
FIG. 4 Is a fragmentary frontal view of the electrical link system and the sliding door system of FIG. 3, illustrated in a fully opened door position.

It will be appreciated that as the door traverses from a fully closed position, illustrated in FIG. 3, to the fully opened position, illustrated in FIG. 4, the chain guard 80 or protective enclosure essentially sequentially segmentally pivots and traverses rearwardly along a variable path having a generally moveable sideways U-shape configuration wherein the lengths of the upper and lower legs inversely incrementally change. Except for the bend and end portions, the ribbon cable and the chain guard are generally positioned approximately parallel to the shelf 86 and the top end surface of the door. The path of the enclosure 80 (and the cable 70) is reversed upon closing the doors. The electrical link system 12 provides a highly reliable power link and signal link between the fixed header and/or the door frame and the sliding door. The system 12 can withstand numerous door openings and closings without jeopardizing the integrity of the electrical connection and without otherwise exposing or failing to amply protect the ribbon cable 70. The ribbon cable 70 can effectively function for thousands of duty cycles in part because the plane of movement of cable 70 is generally parallel to the plane of movement of the door.

Figure 20:
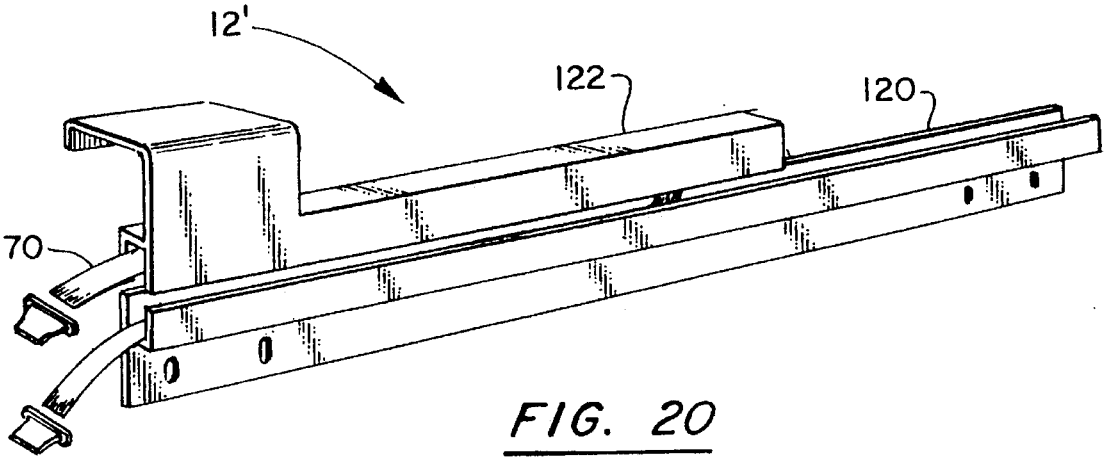
FIG. 20 is an enlarged fragmentary perspective view, partially exploded of another embodiment of an electrical link system in accordance with the present invention.
Figure 21:
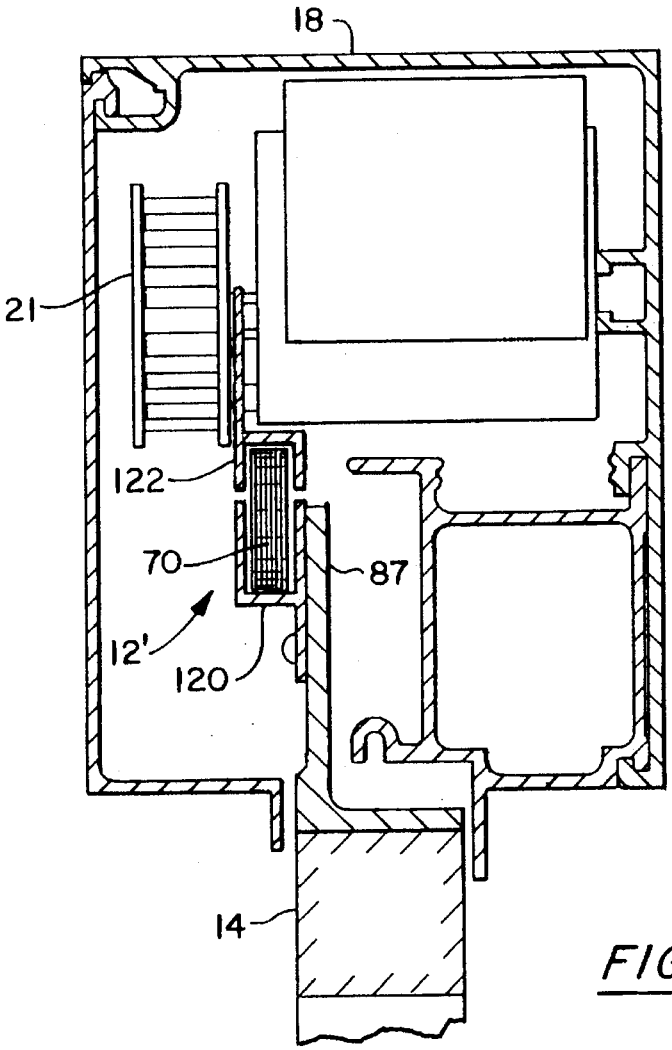
FIG. 21 is an enlarged fragmentary sectional view of the sliding door system of FIG. 5 incorporating the electrical link system embodiment of FIG. 20 and taken along the line 10—10 of FIG. 5.

With reference to FIGS. 20 and 21, another embodiment of an electrical link system 12' of the invention does not employ a chain guard 80. The ribbon cable 70 is instead protected and guided by means of a dual channel enclosure. The enclosure includes an elongated channel section 120 which is mounted at the top portion of the door hang 87. A second inverted channel section 122 is mounted in fixed relationship with the header. The channel sections cooperate to provide a sliding type enclosure and guide for the cable 70 as the door moves between fully opened and closed positions. The ribbon cable 70 essentially rests on the lower section 120 which moves relative to the fixed upper channel section during the door opening and closing sequences. The ribbon conductor generally has the variable U-shaped bend, as previously described. The sides of the channel sections also cooperate to guide and protect the ribbon conductor.

It will be appreciated that approach sensors 40, such as microwave or infra-red sensors, also may be mounted directly to the sliding door to sense the pedestrian traffic approaching the entranceway. The approach sensors 40 communicate to the door controller or operator 17 mounted in the header for initiating the door opening sequence. The infra-red sensors 50 and 60 are advantageously positioned on the sliding door to function as safety sensors for ensuring that the door does not inadvertently open or close.

With reference to FIGS. 11–18, safety sensor 50 is a multiple sensor module which is advantageously mounted at the front edge of each of the moveable doors to provide an effective diffuse reflective safety sensor as well as a threshold holding beam. In one preferred application, the sensor 50 is inconspicuously incorporated into the front edge of the door approximately 28 inches from the floor. The sensor 50 includes a central holding beam unit 90, a diffuse IR receiver section 92 and a diffuse IR transmitter section 94. The holding beam unit 90 includes a transmitter and a receiver. The transmitter generates a holding beam HB1 which is detected by the holding beam receiver on the opposing edge of door panel 16. Likewise, the sensor 50 on panel 16 generates a holding beam HB2 which is detected by the holding beam receiver on panel 14. The sensors are synchronized so that the holding beams alternate and one holding beam unit is in a transmit mode and the other is in a receive mode.

Figure 13:
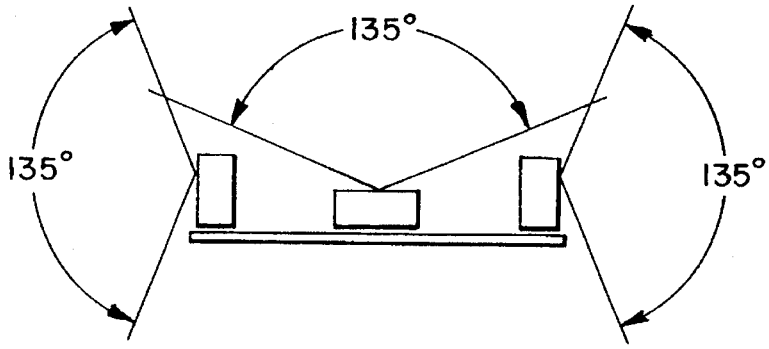
FIG. 13 is a schematic diagram of a receiver portion of a safety sensor employed in the sliding door system of FIG. 11.
Figure 14:
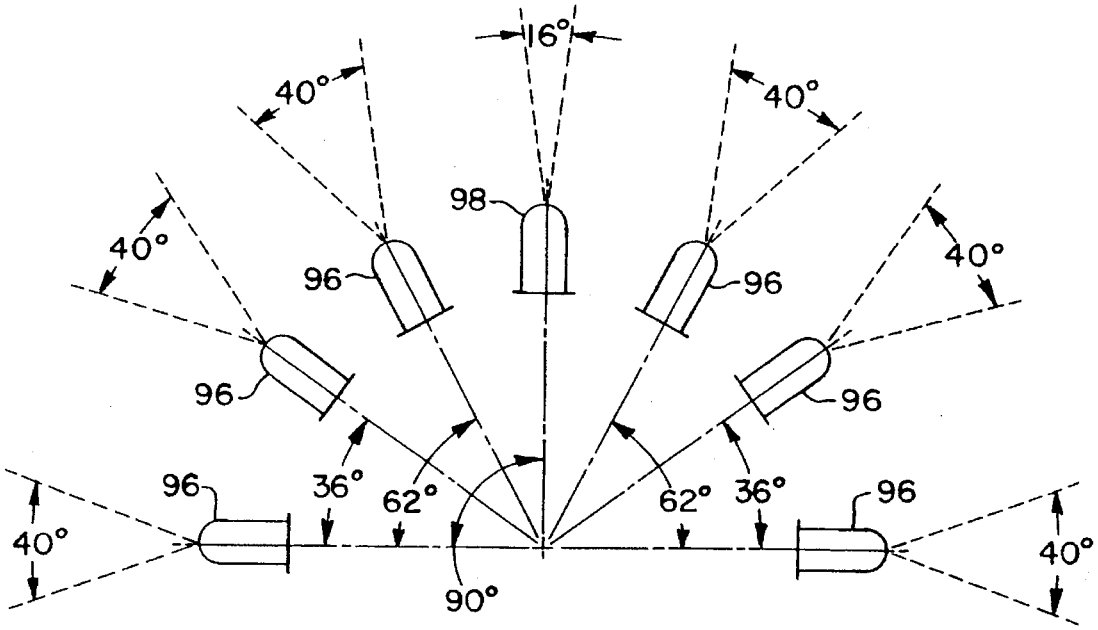
FIG. 14 is a schematic diagram of a transmitter portion of the safety sensor employed in the sliding door system of FIG. 11.

The transmitter section 94 employs an array of seven IR diodes which are arcuately positioned at the leading edge 22 of the door in a horizontal plane, as illustrated in FIG. 14. Six diodes 96 emit diffuse radiation over 40° half-angle sectors. Central diode 98 is oriented for emitting along an axis normal to the leading edge 22 and emits diffuse radiation over a 16° half-angle sector. The receiver section 92 employs three PIN diodes 100 having 135° angle receptivity, as illustrated in FIG. 13. The PIN diodes 100 are oriented along axes normal to the opposing sides of the door panel and the leading stile edge 22.

Figure 15:
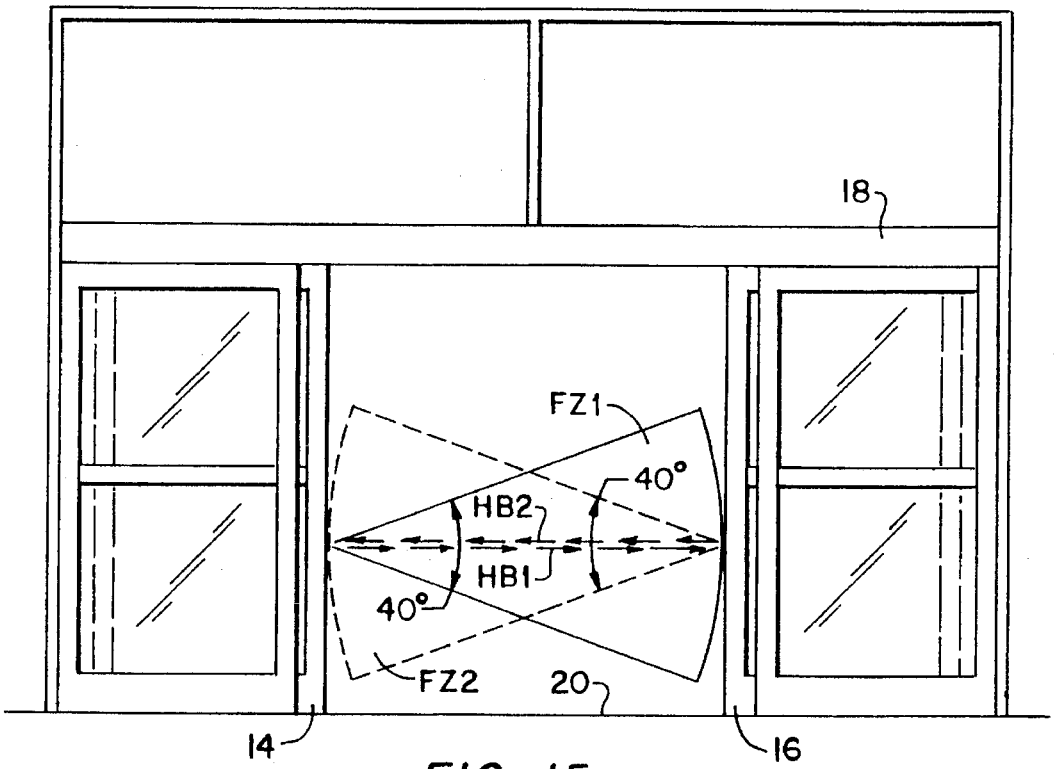
FIG. 15 is an elevational view, partly in schematic, of the sliding door system incorporating a pair of doors such as illustrated in FIG. 11 and further illustrating the safety detection zones thereof.
Figure 16:
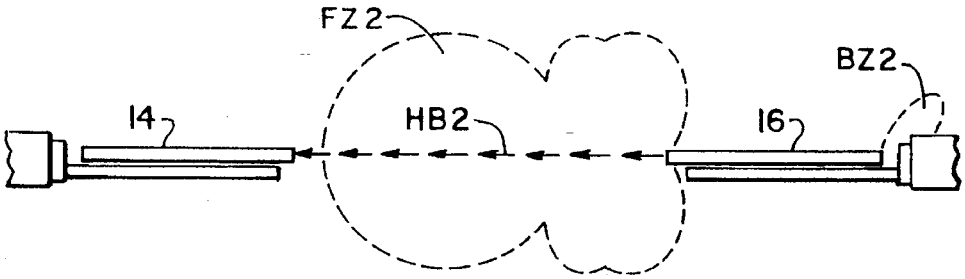
FIG. 16 is a top view, partly in schematic, illustrating the detection zone and holding beam for one of the doors of the sliding door system of FIG. 15.
Figure 17:
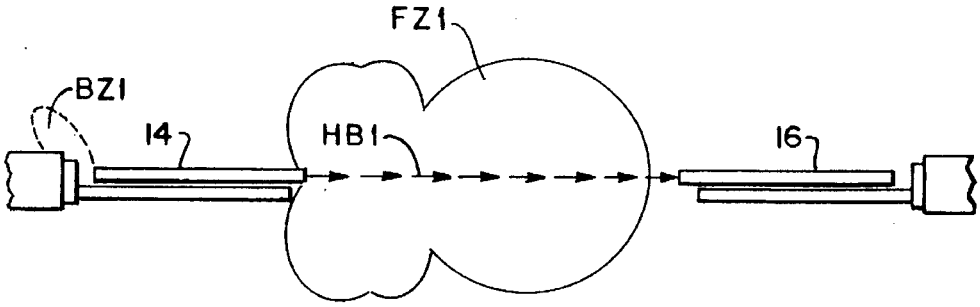
FIG. 17 is a top view, partly in schematic, illustrating the detection zone and holding beam for the second door for the sliding door system in FIG. 15.

As the door panels 14 and 16 are moved between a fully opened and closed position, the adjacent regions on both sides of the threshold are flooded with radiation. The resulting independent detection zones of coverage FZ1 and FZ2 provided by the sensors 50 are illustrated in FIGS. 15–17. The holding beams HB1 and HB2 are also illustrated in the latter figures. The plum-like back edge detection zones BZ1 and BZ2 for sensors 60 of door panels 14 and 16, respectively, are illustrated in FIGS. 16 and 17. The zones FZ1 and FZ2 contract as the doors close and expand as the doors open to thereby closely adapt to the operational status of the doors. The holding beams HB1 and HB2 remain at the same intensity until the doors close at which time the holding beams are turned off.

With reference to FIG. 12, the electrical link system 12 (or 12') provides an electrical signal communication system between each of the safety sensors 50 and the master controller 23 mounted in the header. The master controller 23 communicates with the control box 25 which in turn controls the motor 19 for driving the sliding doors. The encoder 27 is responsive to the motor 19 and provides a feedback signal indicative of the position of the sliding doors.

Figure 18:
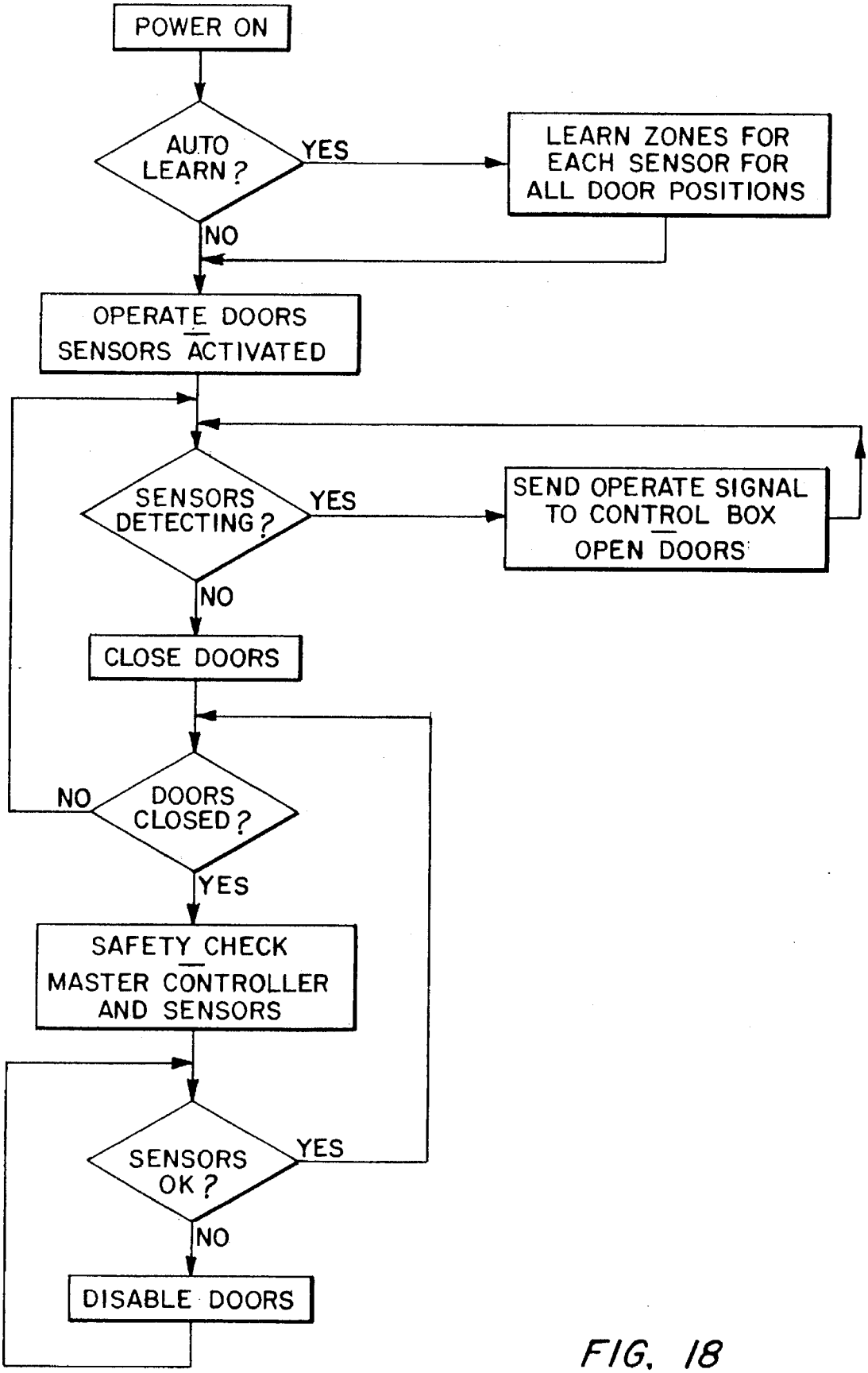
FIG. 18 is a flow chart illustrating the general signal processing steps for the sliding door system of FIG. 11.

With reference to FIG. 18, upon installation and powering up of the sliding door system, the processor in the controller 23 may be transformed to an automatic learn mode wherein each sensor 50 learns the zones for a given installation for various door positions. Zone characteristics for sixteen distinct door positions are employed in one embodiment. After data for the zones FZ1 and FZ2 have been input into the processor, the sensors 50 are activated to commence automatic operation of the doors. When the signals are in a detective mode, an operate signal is transmitted to the control box for opening 25 the doors. In the event that no object or traffic is detected, the doors commence a closing sequence. When the doors are fully closed, a safety check routine is executed by the master controller to verify that the sensors are operating properly. If a defect is found in the operation of the sensors (or the processing), the doors are then disabled so that they may be freely opened.

For installations which employ both sensors 50 and 60, the sensors are connected to the power and the master controller 23 via electrical link systems 12 or 12'. Each sensor is assigned an identification code. The master controller sends serial communications to each sensor to cause the sensor to assume a detection mode or to automatically tune a zone. The master controller 23 processes the signals from the sensors and selectively transmits signals to the control box 25 to open the doors, open the doors at a slow speed or close the doors.

Some of the electrically operated modules mounted to the sliding door may communicate with or be controlled by a remote console or controller (not illustrated).

While the preferred embodiments of the invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A sliding door system comprising:

entranceway means for forming an entranceway comprising header means, and electrical junction means for providing an electrical connection at said header means;

sliding door means comprising at least one sliding door movable across said entranceway;

operator means for automatically operating said sliding door means;

module means comprising at least one electrically operated module mounted to one sliding door;

electrical link means for electrically connecting said junction means and said module means, said link means comprising a flexible electrical ribbon conductor positioned in said header sliding door and enclosure means for protectively enclosing said conductor, said enclosure means comprising at least one rigid enclosure section which moves with said one sliding door, and said enclosure further comprising a multiplicity of pivotally connected chain-like segments.

2. The sliding door system of claim 1 wherein said junction means electrically communicates with said operator means.

3. The sliding door system of claim 1 wherein said one sliding door has a leading edge and an opposite trailing edge, and said module means comprises sensor means mounted to said one door for generating a detection beam traversing from said leading edge.

4. The sliding door system of claim 3 wherein said sensor means comprises holding beam means for generating an infra-red holding beam traversing generally parallel to the movement of said sliding door and diffuse reflective sensor means for sensing traffic in the vicinity of said entranceway.

5. The sliding door system of claim 3 wherein said sensor means further comprises a plurality of vertically spaced sensors for generating an infra-red holding beam traversing from said leading edge.

6. The sliding door system of claim 1 wherein said enclosure means has opposite ends and defines a variable U-shape path as said at least one door moves across said entranceway, one end being mounted to said header means and the other end being mounted to an upper portion of said one sliding door.

7. A sliding door system comprising:

entranceway means for forming an entranceway comprising header means, and electrical junction means for providing an electrical connection at said header means;

sliding door means comprising at least one sliding door movable across said entranceway, said one sliding door having a leading edge and an opposite trailing edge;

operator means for automatically operating said sliding door means;

module means comprising at least one electrically operated module mounted to one sliding door, said module means further comprising sensor means mounted to said one door for generating a detection beam traversing from said leading edge;

electrical link means for electrically connecting said junction means and said module means, said link means comprising a flexible electrical ribbon conductor positioned in said header means and extending between said entranceway means and said one sliding door and enclosure means for protectively enclosing said conductor, said enclosure means comprising at least one rigid enclosure section which moves with said one sliding door; and second sensor means mounted to said one door for generating a second detection beam traversing from said trailing edge.

8. A sliding door system comprising:

entranceway means for forming an entranceway comprising header means, and electrical junction means for providing an electrical connection at said header mean;

sliding door means comprising a pair of sliding doors movable across said entranceway, one said sliding door having a leading edge and an opposite trailing edge;

operator means for automatically operating said sliding door means;

module means comprising at least one electrically operated module mounted to said one sliding door, said module means further comprising sensor means mounted to said one door for generating a second detection beam traversing from said trailing edge;

electrical link means for electrically connecting said junction means and said module means, said link means comprising a flexible electrical ribbon conductor positioned in said header means and extending between said entranceway means and said one sliding door and enclosure means for protectively enclosing said conductor, said enclosure means comprising at least one rigid enclosure section which moves with said one sliding door; and said second sliding door having a leading edge opposing said one sliding door leading edge and further comprising a reflective strip mounted to said second door leading edge.

9. A sliding door system comprising:

entranceway means for forming an entranceway comprising header means, and electrical unction means for providing an electrical connection at said header means;

sliding door means comprising at least one sliding door movable across said entranceway;

operator means for automatically operating said sliding door means;

module means comprising at least one electrically operated module mounted to one sliding door;

electrical link means for electrically connecting said junction means and said module means, said link means comprising a flexible electrical ribbon conductor positioned in said header means and extending between said entranceway means and said one sliding door and enclosure means for protectively enclosing said conductor, said enclosure means comprising at least one rigid enclosure section which moves with said one sliding door, said enclosure means further comprising a pair of cooperative members defining a pair of opposing channels.

10. The sliding door system of claim 9 wherein one member is mounted to said header means and said other member is mounted to said sliding door means.

11. A sliding door system comprising:

entranceway means for forming an entranceway comprising header means, and electrical junction means for providing an electrical connection at said header means;

sliding door means comprising at least one sliding door movable across said entranceway;

operator means for automatically operating said sliding door means;

module means comprising at least one electrically operated module mounted to one sliding door;

electrical link means for electrically connecting said junction means and said module means, said link means comprising a flexible electrical ribbon conductor positioned in said header means and extending between said entranceway means and said one sliding door and enclosure means for protectively enclosing said conductor, said enclosure means comprising at least one rigid enclosure section which moves with said one sliding door; and a shelf mounted to said sliding door and said enclosure means rests on said shelf.

12. A sliding door system comprising:

entranceway means for forming an entranceway comprising header means and electrical junction means at said header means;

sliding door means comprising a sliding door having a leading edge and an opposite trailing edge, said door being moveable across said entranceway wherein said leading edge traverses a first path and said trailing edge traverses a second path;

sensor means comprising at least one sensor mounted to said sliding door adjacent the leading edge thereof for sensing traffic in said first path; and electrical link means for electrically linking said electrical junction means and said sensor means, said electrical link means comprising a ribbon conductor which defines a generally variable U-shaped path as said door moves along said path, and said electrical link means further comprising an enclosure means for protectively enclosing said conductor, and said conductor and said enclosure are housed in said header means.

13. The sliding door system of claim 12 wherein said enclosure means comprises a multiplicity of pivotally connected chain-like sections.

14. The side sliding door system of claim 12 wherein said enclosure means comprises a first channel member mounted to said header means and a second channel member mounted to said sliding door means.

15. A sliding door system comprising:

entranceway means for forming an entranceway comprising header means and electrical junction means at said header means;

sliding door means comprising a sliding door having a leading edge and an opposite trailing edge, said door being moveable across said entranceway wherein said leading edge traverses a first path and said trailing edge traverses a second path;

sensor means comprising at least one sensor mounted to said sliding door adjacent the leading edge thereof for sensing traffic in said first path;

electrical link means for electrically linking said electrical junction means and said sensor means, said electrical link means comprising a ribbon conductor which defines a generally variable U-shaped path as said door moves along said path; and second sensor means mounted to said door adjacent said trailing edge for sensing traffic in said second path.

16. The sliding door system of claim 15 wherein said second sensor means comprises an infra-red sensor.

17. A sliding door system comprising:

entranceway means for forming an entranceway comprising header means and electrical junction means at said header means;

sliding door means comprising a sliding door having a leading edge and an opposite trailing edge, said door being moveable across said entranceway wherein said leading edge traverses a first path and said trailing edge traverses a second path;

sensor means comprising at least one sensor mounted to said sliding door adjacent the leading edge thereof for sensing traffic in said first path;

electrical link means for electrically linking said electrical junction means and said sensor means, said electrical link means comprising a ribbon conductor which defines a generally variable U-shaped path as said door moves along said path; and a second sliding door having a second leading edge opposing said other leading edge and sensor means mounted to both said sliding doors wherein each said sensor means further comprises holding beam means for generating an infra-red holding beam traversing from said leading edge and diffuse sensor means for continuously sensing traffic in the vicinity of said entranceway as said doors move toward a closed position.

18. A sliding door system comprising:

entranceway means for forming an entranceway and electrical junction means at said entranceway;

sliding door means comprising a pair of sliding doors each having a leading edge and an opposite trailing edge, said doors being movable across said entranceway so that said leading edges are disposed in opposing variably spaced relationship;

bi-directional sensor means comprising a plurality sensors mounted to one sliding door, at least one sensor having a detection beam which extends rearwardly from said trailing edge and at least one sensor having a detection beam which extends forwardly from said leading edge; and electrical link means for electrically linking said junction means and said sensor means.

19. The sliding door system of claim 18 wherein said entranceway means further comprises a header and said door has an upper portion and said electrical link means comprises a pair of flexible electrical conductors which extend between said junction means and each said door, said conductors being housed in said header.

20. The sliding door system of claim 19 wherein said conductors each comprise a ribbon conductor which has a variable generally U-shaped configuration between said junction means and said door.

21. The sliding door system of claim 20 further comprising enclosure means for protectively enclosing said conductors, said enclosure means comprising for each conductor a first portion mounted in fixed relationship relative to said header and a second portion mounted in fixed relationship to a said sliding door.

22. The sliding door system of claim 21 wherein said enclosure means each comprises a multiplicity of pivotally connected chain-like segments.

23. The sliding door system of claim 21 wherein said first and second portions each comprise an elongated channel member.

24. A sliding door system comprising:

entranceway means for forming an entranceway;

first electrical junction means in fixed stationary relationship with said entranceway means;

sliding door means comprising a sliding door movable across said entranceway, said sliding door having an upper portion and a second junction means located at said upper portion, said sliding door having a pivot and break away means wherein said door pivots about said pivot upon application of a suitable force;

module means comprising at least one electrically operable module selected from the group consisting of a sensor, a switch, a transparent panel circuit, a light and an electrically actuable lock, said at least one module mounted to a sliding door and electrically communicating with said second junction means; and electrical link means comprising a flexible electrical conductor connecting said first and second junction means, and enclosure means comprising a first rigid portion mounted in fixed relationship relative to said entranceway means and a second rigid portion mounted in fixed relationship relative said sliding door for protectively enclosing said conductor, said electrical conductor traversing a variable path having a moving U-shaped bend which is parallel to the path of the sliding door as said sliding door moves across said entranceway between fully opened and fully closed positions, and said electrical link means is positioned relative to said pivot so that when said door is pivoted, electrical communication is maintained between said module means and first electrical junction means.

25. The sliding door system of claim 24 wherein said conductor comprises a ribbon conductor.

26. The sliding door system of claim 24 wherein said enclosure means comprises a multiplicity of pivotally connected chain-like housing segments having opposed end segments, one segment fastened in fixed position to said entranceway means and a second segment fastened in fixed position to said sliding door.

27. A sliding door system comprising:

entranceway means for forming an entranceway comprising header means and operator means and controller means for controlling said operator means;

sliding door means comprising a pair of sliding doors each having a leading edge and an opposite trailing edge, said doors being moveable along a door path by said operator means across said entranceway so that said leading edges are disposed in opposing variably spaced relationship;

safety sensor means comprising a sensor unit mounted to each sliding door adjacent the leading edge thereof for sensing traffic between said leading edges and traffic in the vicinity of said entranceway;

electrical link means for electrically linking said controller means and said sensor means, so that said doors are moveable in response to said safety sensor means, said link means comprising an electrical ribbon cable traversing a variable path parallel to said door path, said electrical link means further comprising enclosure means for protectively enclosing said cable for each said door, said enclosure comprising guide means for guiding said cable; and header means disposed above said entranceway, said conductor and enclosure means being disposed in said header means at a location adjacent the top of said corresponding door.

28. The sliding door system of claim 27 wherein said sensor unit comprises a receiver comprising a first diode oriented on a first axis normal to said leading edge and second and third oppositely positioned diodes oriented on an axis orthogonal to said first axis.

29. The sliding door system of claim 27 wherein said sensor unit comprises a plurality of infra-red emitters oriented in an arcuate array having a central emitter oriented on an axis normal to said leading edge.

30. The sliding door system of claim 29 wherein each sensor unit comprises seven diffuse emitters.

* * * * *